United States Patent [19]

Bartlett

[11] Patent Number: 4,899,133

[45] Date of Patent: Feb. 6, 1990

[54] PROGRAMMABLE MOVEMENT ANALYZER WITH A PLURALITY OF MERCURY SWITCHES

[75] Inventor: Alan Bartlett, New Braunfels, Tex.

[73] Assignee: Detex Corporation, New Braunfels, Tex.

[21] Appl. No.: 153,162

[22] Filed: Feb. 8, 1988

[51] Int. Cl.[4] ..... G08B 23/00

[52] U.S. Cl. ..... 340/573; 340/689; 200/61.47; 200/DIG. 2; 364/550

[58] Field of Search ..... 340/568, 571, 572, 573, 340/689; 128/903; 200/153 J, 153 V, DIG. 2, 61.47; 364/413.02, 559, 550

[56] References Cited

U.S. PATENT DOCUMENTS

| | | | |
|---|---|---|---|
| 4,057,791 | 11/1977 | Bimmerle et al. | 340/571 |
| 4,112,926 | 9/1978 | Schulman et al. | 340/573 |
| 4,205,300 | 5/1980 | Ho et al. | 340/528 |
| 4,284,983 | 8/1981 | Lent | 340/571 |
| 4,314,240 | 2/1982 | Schüg | 340/571 |
| 4,327,360 | 4/1982 | Brown | 340/571 |
| 4,399,432 | 8/1983 | Lunn | 340/573 |
| 4,414,541 | 11/1983 | Ho | 340/571 |
| 4,418,337 | 11/1983 | Bader | 340/571 |
| 4,450,437 | 5/1984 | Ho | 340/573 |

OTHER PUBLICATIONS

Signal Systems Catalog 026.
Alert-COM Instruction Manual.
Firefly Instruction Manual.

*Primary Examiner*—Joseph A. Orsino
*Assistant Examiner*—Jill D. Jackson
*Attorney, Agent, or Firm*—Arnold, White & Durkee

[57] ABSTRACT

An alert device is provided which initiates an alarm if a person wearing the device ceases normal movement. The device includes a movement sensor having at least one mercury switch which generates a signal when the mercury shifts in response to movement. The device also includes a microcomputer to receive the mercury switch input signals—the microcomputer being programmed to distinguish between inputs indicative of normal wearer movement and inputs which may represent a wearer in duress. Preferably, the motion sensor provides three mercury switches oriented to sense movement in three normal planes.

18 Claims, 4 Drawing Sheets

POWER UP RESET
SELF TEST (SHORT)
SYSTEM INITIALIZE
SET DOWNTIME
RESET TIMEOUT FLAG 1
VALID MOTION FLAG
READ MOTION SENSORS
VALID MOTION?
NO
YES
DRIVER CIRCUIT
SENSOR
MICROPROCESSOR

PROGRAMMABLE MOVEMENT ANALYZER WITH A PLURALITY OF MERCURY SWITCHES

BACKGROUND OF THE INVENTION

1. Field of the Invention

This invention relates to a motion sensor worn by a person having at least one mercury switch for detecting motion of the person to initiate an alarm when normal motion ceases.

2. Description of Related Art

Personal alert devices (often called "PASS" units in the industry) are known which are worn by persons working in hazardous environments. In a hazardous environment, a worker might be overcome by elements in their environment such as smoke, fumes, heat, electrical shock, or falling debris. It is desirable to sense when a person has been disabled or is in duress and to generate a warning signal so that the person can be located and rescued. Typical users of such personal warning devices include firemen, petrochemical workers, miners, electricians, sewage engineers, nuclear power plant workers, and military personnel.

While such personal warning devices are known, all such current devices are deficient in a number of respects. The most typical problems of known personal warning devices are that they either initiate a false alarm when the wearer is continuing normal activity, or they fail to initiate an alarm when the wearer becomes disabled. Further, all of these personal warning devices are unable to distinguish between many types of normal working activity and duress situations.

Most known personal alarm systems use one of two types of motion sensors. The first type of motion sensor uses a cantilevered lever which is fixed at one end and has a contact at the movable end. The lever may be either a rigid clapper or a spring. A mating contact surrounds the movable end of the cantilever lever. Thus, normal motion is supposed to periodically establish contact between the movable end and surrounding mating contact. This design must have a sufficiently rigid lever that when oriented in various axes the lever does not establish electrical contact due to gravity and inadvertently become inoperative (i.e. giving a false indication of normal activity). Unfortunately, such a rigid lever prevents detection of slow changes in motion (possibly normal activity). The spring-type of cantilevered lever often fatigues with time and use, thus changing its operating characteristics. The spring-type of lever also does not provide uniform repeatable contact closure resistance and severe shock to motion sensor can cause the spring or its mating contact to be physically damaged.

The second common type of motion sensor incorporates a movable ball which rolls in an enclosure such as a cylinder or sphere. Wearer motion is detected when the ball shorts electrical contacts in the enclosure as it rolls about. A variation of this type of motion sensor fixes a piezoelectric material to the enclosure such that electrical voltages are produced when the ball moves. Such ball sensors are very sensitive to small movements and do not provide an easy mechanism for discriminating between normal motion and a possible duress situation.

As can be appreciated, known personal warning systems all incorporate motion sensors which are not always reliable and dependable. Further, such personal warning systems are largely ineffective in distinguishing between many types of normal activities and duress situations.

SUMMARY OF THE INVENTION

The personal warning system of the present invention largely solves the problems associated with known personal alarms by providing a movement sensor which is not only reliable and accurate, but also is capable of distinguishing between most types of normal movement and duress situations. Broadly speaking, the device includes a housing, a power supply, a warning mechanism, and a switch for activating the power supply. The movement sensing mechanism includes a mercury switch means having an enclosure, a pair of contacts disposed in the enclosure, and a pool of mercury shiftably disposed in the enclosure for electrically connecting and disconnecting the contacts upon motion of the person. Preferably, the switch mechanism includes three mercury switches generally aligned in three normal planes for detecting motion in three axes. Thus, the switches can determine when motion has ceased in one plane, i.e. when the mercury pool in the mercury switch quits moving to connect and disconnecting from the contacts.

In a preferred embodiment, the movement sensing mechanism includes a microcomputer connected for receiving inputs from the mercury switches. The microcomputer can be programmed for distinguishing between normal movement and a duress situation, based upon inputs from the mercury switches. For example, normal movement can be defined and programmed as requiring both ends of one of the three switches to connect and disconnect electrically at least once within a thirty second period. If such connection/disconnection sequence is not made within the programmed interval by all three switches, the warning mechanism will be activated.

DESCRIPTION OF THE PREFERRED EMBODIMENTS

Figure 1:
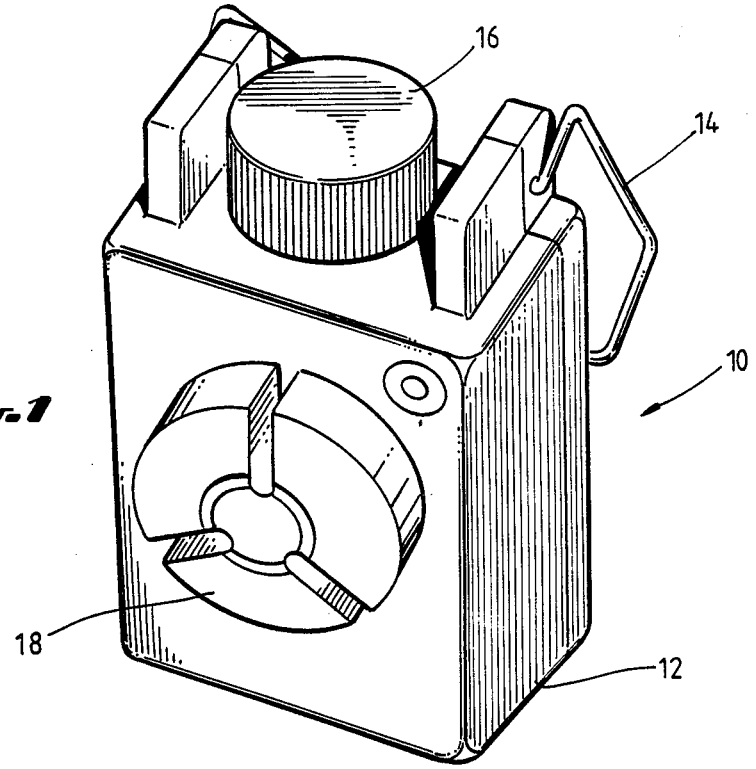
FIG. 1 is a perspective view of a personal warning device in accordance with the present invention.

Turning now to the drawings, a personal alert device 10 in accordance with the present invention is illustrated. As shown in FIG. 1, the device includes a housing 12 with a clip 14 for attaching the device to a person. Mounting switch 16 is mounted to the housing 12 and preferably is a two motion switch which requires a push and turn movement to position the switch out of the off position. The switch is three positioned for operating in the off, on, and automatic modes. On the front of the housing 12, is a piezoelectric horn system 18 comprising a piezo sounder within an acoustic enclosure.

Figure 2:
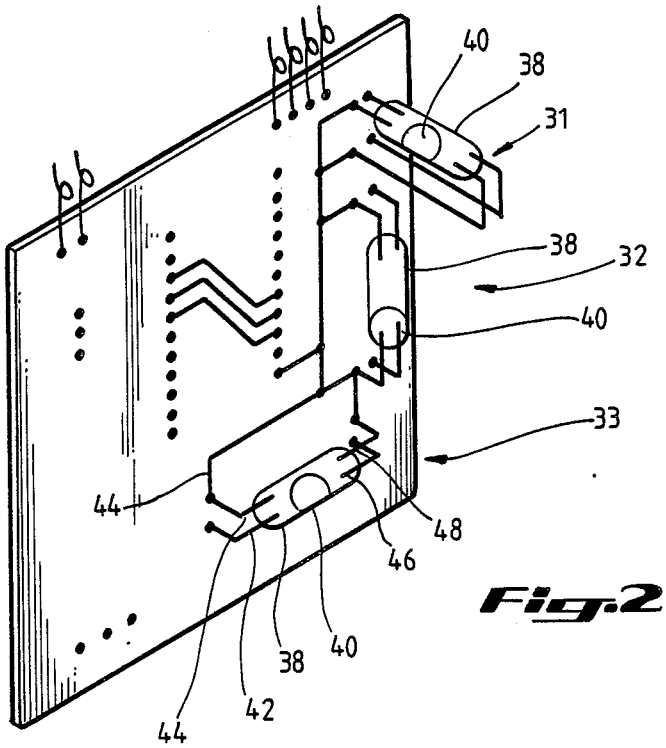
FIG. 2 is a perspective view of a portion of the circuit board incorporated in the personal warning device hereof, illustrating the three mercury switches.
Figures 3, 4:
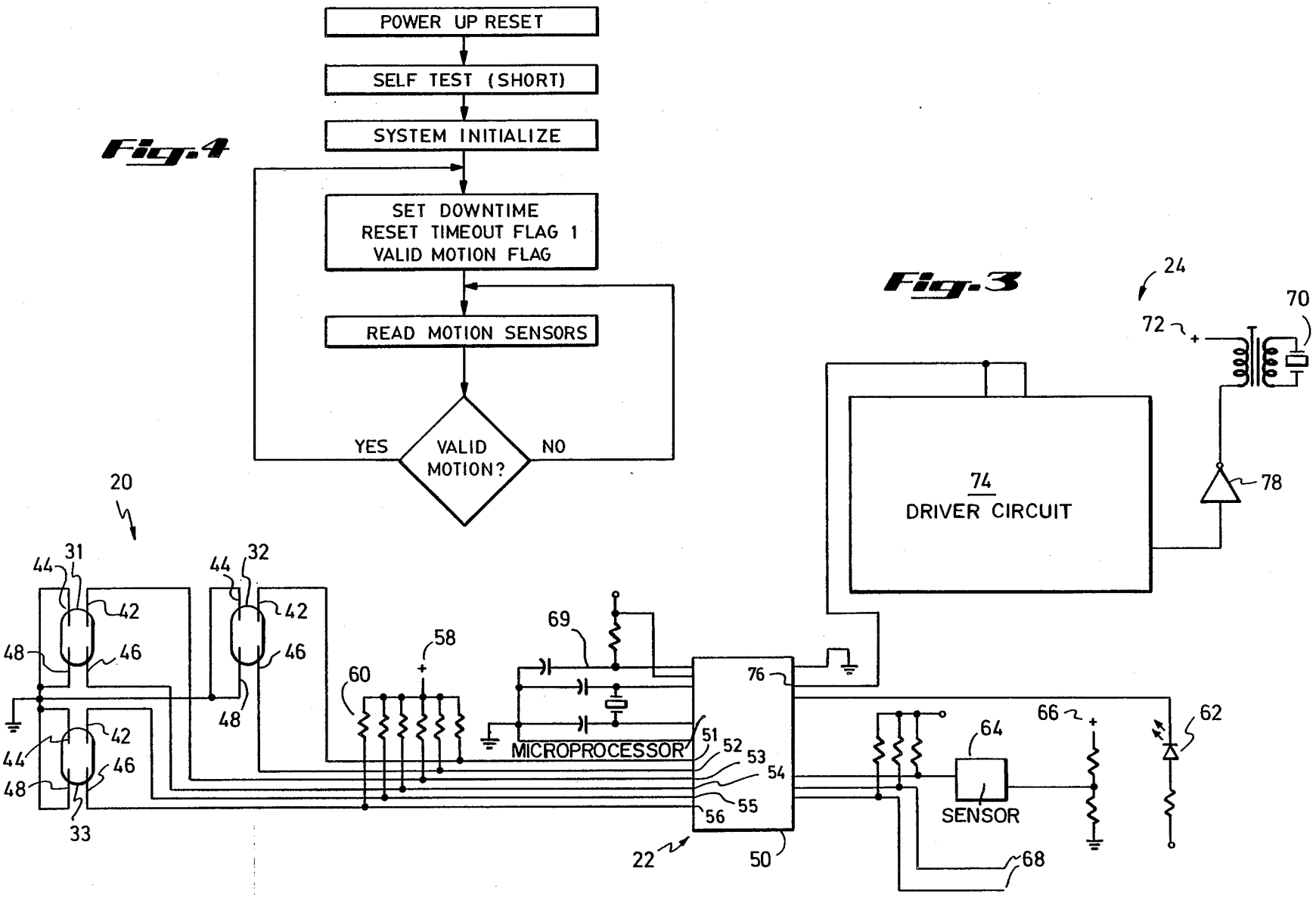
FIG. 3 is a circuit diagram showing the interface between the mercury switches, microcomputer, and warning system of the present invention.
FIG. 4 is a flow chart of the main run program of the microcomputer.

Turning now to FIG. 3, an electrical schematic of the sensing mechanism is illustrated and broadly includes a switch circuit 20, microcomputer 22 and horn system 24. In more detail (left hand side of FIG. 3), the switch circuit 20 includes three mercury switches 31–33. FIG. 2 illustrates the mounting of the mercury switches 31–33 in more detail on circuit board 36. Each mercury switch 31–33 is a double switch-type packaged in a cylindrical or crescent-shaped tubular enclosure 38 (FIG. 2). Each enclosure 38 is elongated and includes a pool of mercury 40 shiftably disposed therein. As can be seen from comparing FIGS. 2 and 3, one end of each mercury switch 31–33 includes a pair of contacts 41, 44 (e.g. hot contact and ground contact), while the other end also includes a pair of contacts 46, 48 (hot and ground). FIGS. 2 and 3 show the ground contacts 44 operably interconnected to the ground.

As can be appreciated from FIG. 2, each mercury switch 31–33 is oriented so that its pool of mercury 40 moves along a certain axis defined by the geometry of the enclosure 38. It will be appreciated that if the enclosure 38 is circular or crescent-shaped, the pool of mercury 40 would be moving generally along a plane of movement. The plane of movements are generally perpendicular to each other as can be seen from FIG. 2. Thus, the mercury pools 40 are responsive to movement of the circuit board 36 in approximately three normal planes.

Returning to FIG. 3, the microcomputer section 22 is largely self-explanatory from the circuit diagram, and of course the principal component is the microprocessor 50 (e.g. Motorola MC 1468705F2CS). Ports 51–56 (PA0–PA5) are operably interconnected to the hot contacts 42 and 46 as shown in FIG. 3. For example, port 51 is connected to contact 42 in mercury switch 32, while port 52 is connected to the opposite end hot contact 46 in mercury switch 32. A power supply 58 is illustrated schematically to power the lead lines to ports 51-56 across resistors 60 (e.g. 47 ohms). In the preferred embodiment, the power supply 58 is a conventional nine volt battery, stepped down (not shown) to supply a regulated five volt power source.

LED 62 is connected to the microprocessor 50 (port PB1) and is controlled to indicate battery state. Hysterisis sensor 64 is powered at 66 at nine volts, while lead 68 interconnects the switch 16 with the microprocessor 50 (port PC1) for enabling the automatic mode. An external clock circuit 69 provides timing to the microprocessor 50, as shown.

The horn system 24 includes the piezo sounder 70 powered at plus nine volts from the battery as at 72. The driver circuit denoted by the block 74 is operably connected to the microprocessor 50 at port 76 (PB0) and drives the piezo sounder 70 through op amp 78.

Software

FIGS. 4–7 illustrate flow charts for the programming of the microprocessor 50. In general overview, the object of the programs is to initiate an alarm if "valid motion" is not detected within the switch circuit 20. In the preferred embodiment, if such "valid" motion is not detected within a 23 second period, a prealarm chirp sounds, and if after an additional 7 seconds "valid" motion has not occurred, the full alarm sounds. Thus, the alert device 10 is programmed to sound a full alarm if "valid" motion is not detected within a 30 second period.

FIG. 4 illustrates the flow chart for the main program. As shown, on power up ports are reset and an internal processor self test initiated. The system initialization includes defining the I/0 ports and setting the timer value at 225 decimal ticks. For the microprocessor 50, setting the timer value at 225 gives 16 interrupts per second. The system initialization also includes enabling the interrupt function—thus, every 1/16 second a jump occurs to the Timer Interrupt Service routine of FIG. 5.

As shown in FIG. 4, after initialization, the main continuous loop sets timing counters and samples the motion sensors to determine if "valid" motion has occurred. Thus, the Downtime counter is set at 23, 23 seconds being the period chosen for initiating the prealarm chirp if valid motion has not occurred. The Timeout flag and Valid Motion flags are also reset, the Timeout flag indicating whether the system has entered the 7 second prealert state. The main program then reads the motion sensor by sampling the three mercury switches 31–33 and determines whether "valid" motion has occurred. The switch read and valid motion determination is illustrated in more detail in FIG. 7.

Figure 7:
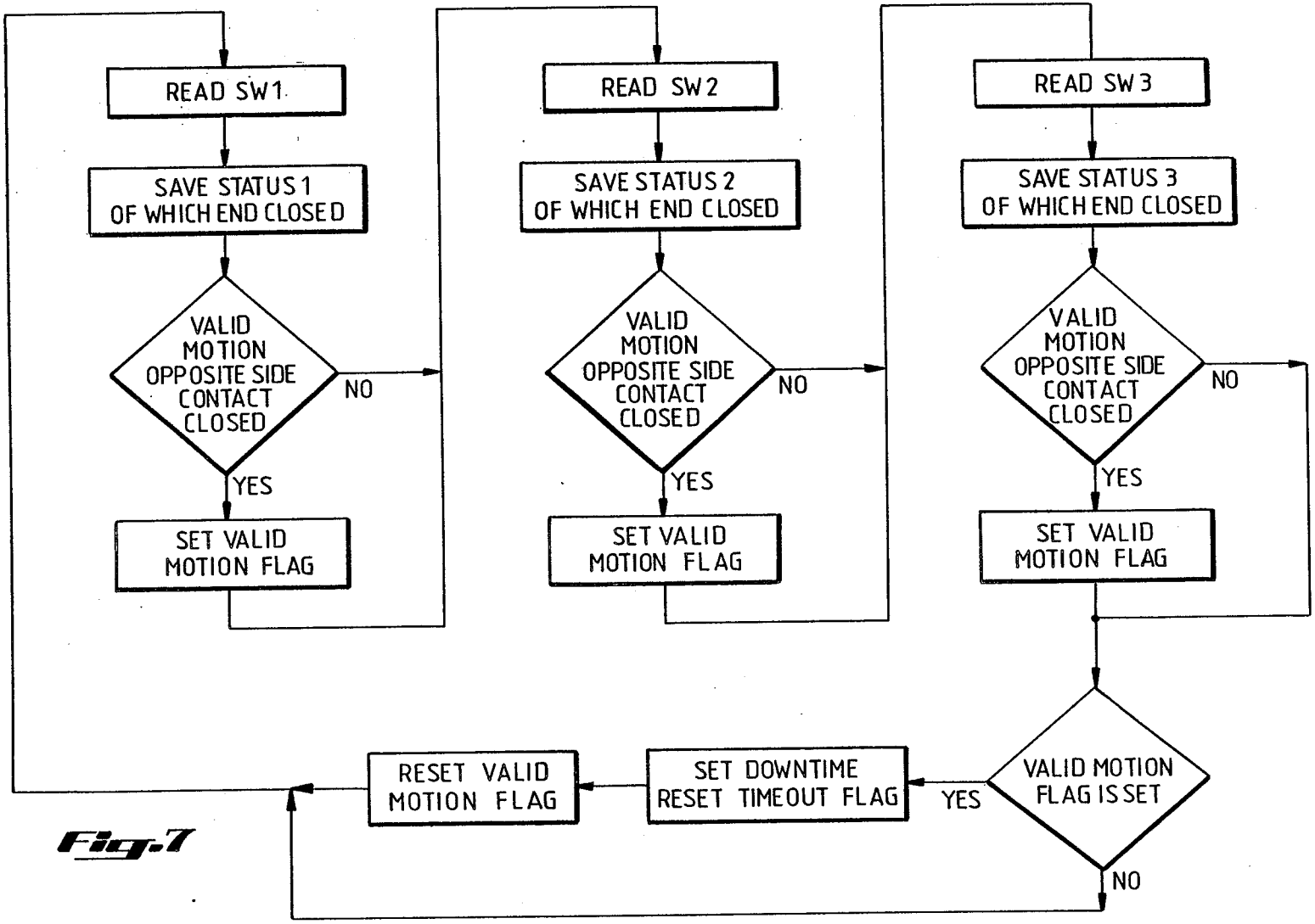
FIG. 7 is a flow chart depicting the motion detection subroutine.

Broadly speaking, FIG. 7 illustrates that valid motion is defined as requiring one of the three mercury switches 31–33 to make and break its contact at each end at least once within the period (the initial period being defined as 23 seconds). Thus, turning to the left hand portion of FIG. 7, the first mercury switch 31 is sampled and the presence of a signal at one of the ports 53, 54 determines which end of the switch 31 is connected by the presence of a mercury pool 40. The status of which end of the switch 31 is closed is stored. On subsequent loops the "valid motion" decisional block tests the opposite end contacts for connection. For example, if in mercury switch 31 the first sample determines connection between contacts 42, 44 (FIG. 2) this status is stored. On subsequent loops contacts 46, 48 of switch 31 are sampled (via port 54) for connection (i.e. the mercury pool 40 shifted).

As illustrated in FIG. 7, if the opposite side contact closes, the valid motion flag is set and the status of the second switch, mercury switch 32, is read. If the opposite side contact is not closed, the valid motion flag is not set and the loop continues to read the second switch. As can be seen from FIG. 7, switches 2 and 3 (mercury switches 32–33) are progressively read in the same fashion.

It can be appreciated that "valid motion" for each switch 31–33 is thus defined as the transit of the pool of mercury 40 from one side of the mercury switch to the other side within the period. If "valid motion" is detected for a mercury switch, the valid motion flag is set.

Turning to the decision loop at the bottom of FIG. 7, it can be seen that the valid motion flag is read and action taken accordingly. In the preferred embodiment, at least one mercury switch must indicate valid motion (i.e. valid motion flag set) to enter the "yes" loop. If the valid motion flag is set, then the Downtime and Timeout flags are reset, and the valid motion flag is reset. If the valid motion flag is not set, then the "no" loop is entered and the three switches 31–33 are continuously sampled for valid motion during the period.

Figure 5:
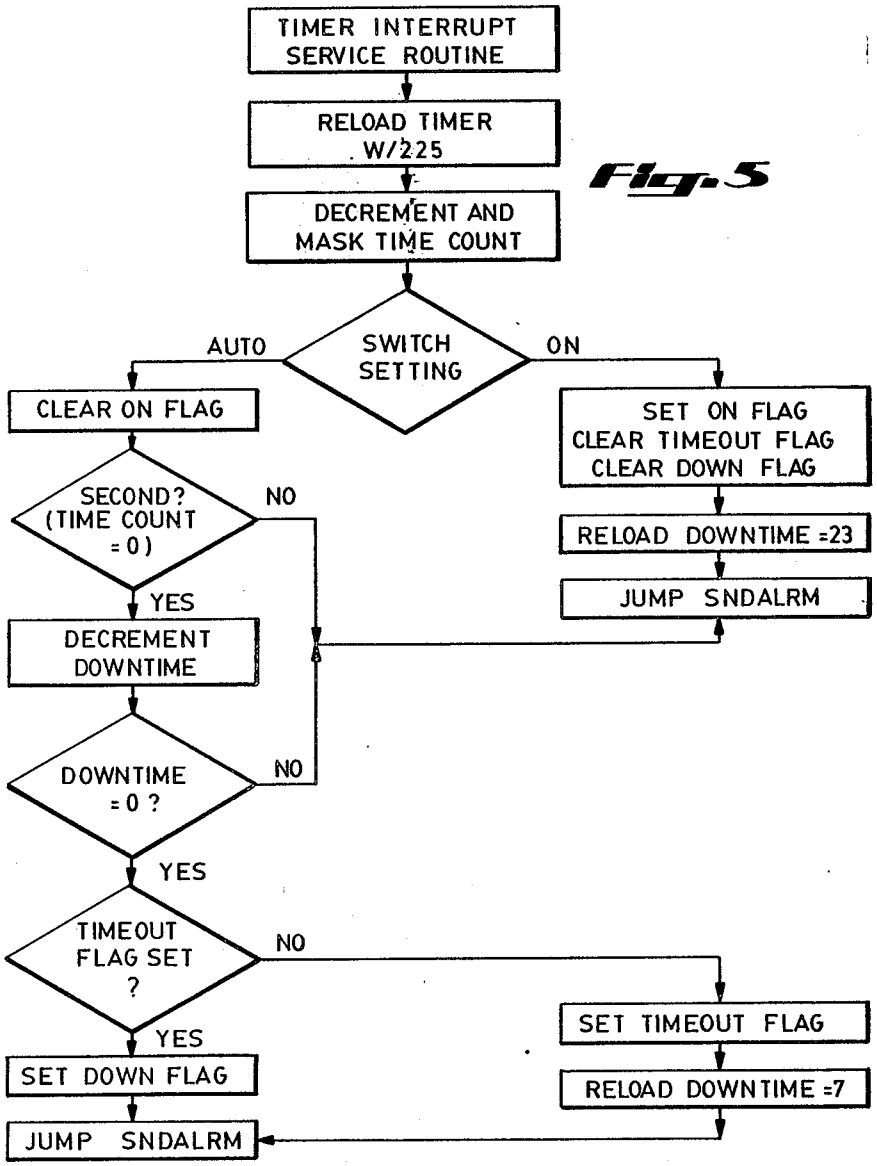
FIG. 5 is a flow chart of the timer interrupt service routine.

Turning now to FIG. 5, the Timer Interrupt Service routine is illustrated. The Timer Interrupt Service routine is entered every 1/16 of a second from the main program of FIG. 4 to continuously read the Downtime and Timeout flags. The timer is first reloaded and time count decremented so that 16 ticks equals one second. The setting of switch 16 then determines whether the "on" or "auto" loops are entered. In the "on" position, the Timeout and Downtime flags are cleared and Downtime counter reset. The "on" flap is set such that at the jump to the Sound Alarm routine the piezoelectric horn 70 will enunciate.

In the "auto" position, the "on" flag is first cleared and a decision is made as to whether the Time Count is equal to zero. If the Time Count is equal to zero, then one second has passed and Downtime is decremented (starting from 23). If the Time Count does not equal zero, then the jump is made to the Sound Alarm routine.

As can be seen from FIG. 5, Downtime is decremented and the jump made to the Sound Alarm routine until Downtime equals zero. If Downtime equals zero, then the Timeout flag is sampled and the decision loops as shown in FIG. 5 prior to the jump to the Sound Alarm routine. Thus Timeout flag simply indicates whether the initial 23 second period is in effect.

Figure 6:
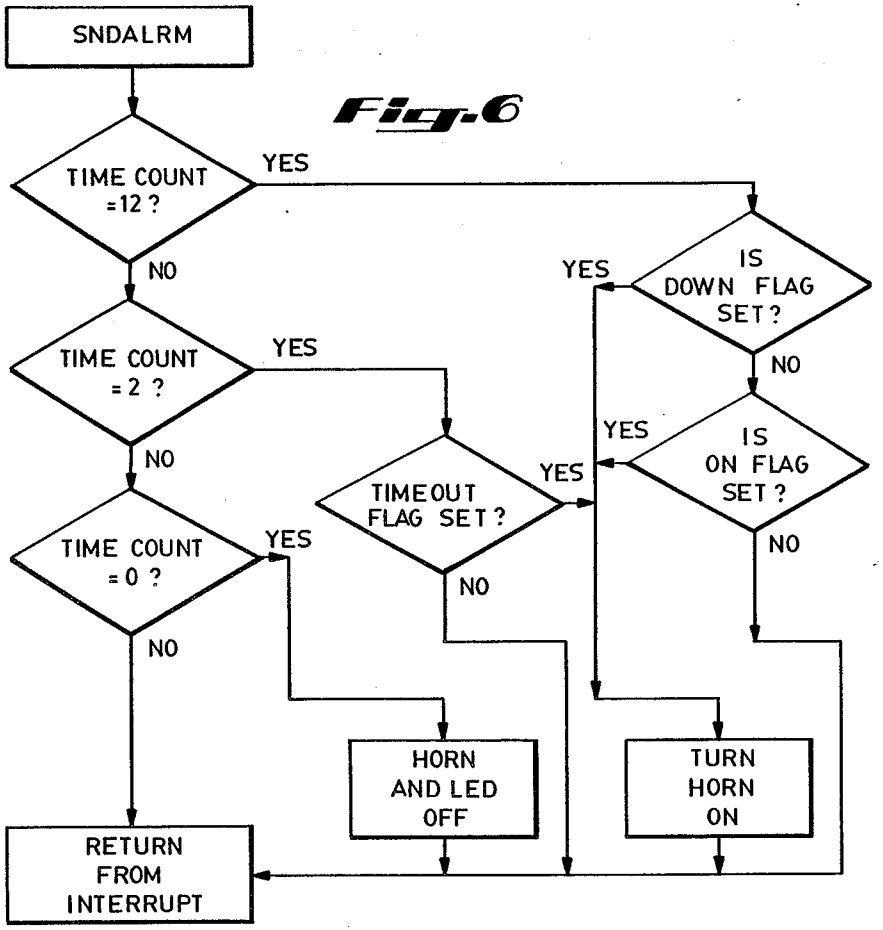
FIG. 6 is a flow chart of the Sound Alarm routine.

Turning to the Sound Alarm routine of FIG. 6, a comparison of FIGS. 5 and 6 is useful. With the switch 16 in the "on" position, the "on" flag is set (FIG. 5), and when the Sound Alarm routine is entered, the piezo horn 70 is turned on as indicated in FIG. 6. If the switch 16 is in the "auto" position of FIG. 5, it is similarly seen that when Downtime equals zero and the Timeout flag is set, the Down flag is set. After the jump to the Sound Alarm, the piezo horn 70 is turned on. In the event Downtime is equal to zero, but the Timeout flag is not set (FIG. 5), this indicates that the device 10 is in the prealert stage and therefore the Downtime value is set at 7 before the jump is made to Sound Alarm. Note from FIG. 6 that with the Timeout flag set, the piezo horn 70 is sounded, although it is operated during the 7 second pre-alert at a "chirp" and not full alarm.

Operation

The alert device 10 of FIG. 1 has two operating modes depending on the position of switch 16—"on" and "auto." In the "on" condition the microprocessor 50 is enabled such that the piezo horn 70 is almost immediately actuated.

In the "auto" mode of operation, the mercury switches 31–33 are continuously sampled and the microprocessor 50 run to determine if valid motion is present. As can be seen from FIGS. 2–3, active movement of a worker will cause the pools of mercury 40 to establish electrical connects and disconnects between the contacts at each end of the enclosures 38. That is, each pool of mercury 40 shorts the electrical contacts 42–44 at one end, and movement or a change of direction by more than 90~ causes a short of electrical contacts 46, 48 at the other end of the particular mercury switch. Because the three mercury switches are mounted approximately 90° relative to each other (X-Y, X-Z, and Y-Z planes), motion is sensed in three planes when an electrical connect and disconnect is made in each plane.

Broadly speaking, the alert device 10 when worn by a person generates an alarm when "normal" or "valid" motion of the wearer ceases. The microcomputer section 22 monitors the output of the switch circuit and when the microcomputer section 22 determines that "valid" or normal motion is not present, then the piezo sounder 70 is activated.

In the preferred embodiment "valid" motion is defined as requiring any of the mercury switches 31–33 making and breaking contact at each end at least once within the chosen time period (initial period of 23 seconds). In an alternative embodiment, the microprocessor may be programmed so that "valid" motion requires more than one of the mercury switches 31–33 to make and break contact at each end. Such reprogramming might be desirable depending on the intended field use of the alert device 10.

Another viable alternative embodiment uses only one mercury switch, instead of three. However, such an alert device 10 would only be able to sense valid motion in one plane. The use of three planes of motion sensing enables the alert device 10 to distinguish between normal worker activity and secondary movements for any position of orientation of the alert device. For example, if the worker is overcome by smoke or fumes and is laying on the floor, the worker might continue heavy breathing. Such heavy breathing could induce motion detection in one plane and possibly two planes (successive connects and electric disconnects of one or two of the mercury switches 31–33). However, the mercury switches might not indicate valid motion. As can be appreciated from FIG. 7, contact closures at only one end of one or two mercury switches, such as might be expected from the motion induced by heavy breathing, is not programmed as valid motion and the piezo sounder 70 will be activated. While the piezo sounder 70 is the preferred warning mechanism, an electrical mechanical warning device might be used, or a telemetry mechanism for remote alarm might be incorporated.

The motion sensing mechanism of the present invention incorporating one or more mercury switches is advantageous in many respects. First, the mercury switches not only provide a very low electrical resistance contact, but also are able to detect changes in velocity in a given plane of motion. Further, by using three mercury switches, the device 10 is able to detect motion in three perpendicular planes. Use of a microcomputer in conjunction with three mercury switches enables the alert device 10 of the present invention to distinguish between normal activity of the wearer and abnormal movement which might be indicative of a duress situation. Advantageously, the mercury switches are not only sufficiently sensitive to prevent false alarms, but also are also shock resistant, relatively temperature independent, reliable, small and inexpensive. Therefore, the motion sensor having a mercury switch in accordance with the present invention represents a significant advance over known personal alert devices.

What is claimed is:

1. A device for warning when a person has ceased normal movement comprising:

a housing;

power supply means coupled to the housing;

means coupled to the housing and operably connected to the power supply means for selectably initiating a warning;

switch means operably connected to the power supply means; and means connected to the power supply means and warning means for sensing and analyzing movement of a person wearing the device and for enabling operation of the warning means if normal movement ceases, including— mercury switch means having at least two switches, each switch having structure defining an enclosure, at least a pair of electrical contacts disposed in the enclosure, and a pool of mercury shiftably disposed in the enclosure for electrically connecting and disconnecting the contacts upon motion of the person, the two switch enclosures being skewed relative to each other, a microcomputer operably connected for receiving separate inputs from each of said two mercury switches, the microcomputer being programmed for determining normal movement from the switch inputs, normal movement being programmed as requiring at least two switches to connect and disconnect electrically within less than about a 30 second period.

2. The device according to claim 1, said movement sensing means being operable for enabling operation of the warning means unless the mercury switch means makes an electrical connect and disconnect within less than about a 30 second period.

3. The device according to claim 1, the warning means comprising a piezoelectric horn.

4. The device according to claim 1, the mercury switch means comprising three switches each having an axis of movement of mercury within an elongated enclosure, the three axes being disposed generally 90° to each other.

5. The device according to claim 1, said switch means being operable between three positions—a first position to disconnect the power supply means; a second position to immediately enable operation of the warning means to initiate a warning; and a third position to enable the movement sensing means to selectably control operation of the warning means.

6. The device according to claim 1, the power supply means and movement sensing means being disposed within the housing and the housing being generally hermetically sealed.

7. The device according to claim 1, each enclosure defining a general plane of movement for the mercury between two ends.

8. The device according to claim 7, each enclosure being cylindrical and having a pair of contacts at each end.

9. The device according to claim 7, the plane of movement of each switch being skewed relative to each other to monitor movement in two planes.

10. The device according to claim 9, the two planes of movement being oriented about 90° relative to each other.

11. In a safety device adapted for wearing by a person which initiates an alarm when the person ceases normal motion the improvement comprising:

a motion sensor having at least two mercury switches each comprising an enclosure, a pool of mercury shiftably received in the enclosure, and at least one pair of electrical contacts in the enclosure, the mercury being responsive to motion by shifting in the enclosure to electrically connect and disconnect the contacts, the motion sensor including a microcomputer coupled to each mercury switch for receiving a separate input from each mercury switch when the contacts of the respective switch are connected, the microcomputer being programmed for initiating the alarm if an input is not received from two switches within about a 30 second period.

12. The device according to claim 11, the microcomputer being programmed for initiating a first alarm if an input is not received from at least two mercury switches within about a 23 second period and for initiating a second alarm if an input is not received from at least one mercury switch within about a 7 second period following the 23 second period.

13. The device according to claim 11, each mercury switch having an elongated enclosure with a pair of electrical contacts at each end.

14. The improvement according to claim 11, the mercury switches each having a plane of movement of the mercury within the enclosures, the planes being skewed relative to each other.

15. The device according to claim 14, including a third mercury switch having a plane of movement, the three planes being oriented generally 90° to each other for sensing motion in three normal planes.

16. In a safety device adapted for wearing by a person which initiates an alarm when the person ceases normal motion, the improvement for determining when normal motion ceases, comprising:

a pair of switches, each switch being operable to generate a signal in response to motion in a plane of movement, the two planes of movement being skewed to each other;

a microcomputer coupled to each switch for receiving separate signals from each switch, the microcomputer being programmed for initiating an alarm if signals are not received from each switch within a certain time period.

17. The apparatus according to claim 16, including a third switch responsive in a plane of movement, the three planes of movement being oriented about 90° to each other.

18. The apparatus according to claim 16, each switch comprising a mercury switch having structure defining an enclosure, at least a pair of electrical contacts disposed in the enclosure, and a pool of mercury shiftably disposed in the enclosure for electrically connecting and disconnecting upon motion of the person.

* * * * *